US007360371B2

(12) United States Patent
Feinauer et al.

(10) Patent No.: US 7,360,371 B2
(45) Date of Patent: Apr. 22, 2008

(54) REFRIGERATING DEVICE COMPRISING AN EVACUATABLE STORAGE COMPARTMENT

(75) Inventors: Adolf Feinauer, Giengen (DE); Micharel Neumann, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 169 days.

(21) Appl. No.: 10/531,820

(22) PCT Filed: Oct. 15, 2003

(86) PCT No.: PCT/EP03/11442

§ 371 (c)(1),
(2), (4) Date: Apr. 18, 2005

(87) PCT Pub. No.: WO2004/036129

PCT Pub. Date: Apr. 29, 2004

(65) Prior Publication Data

US 2006/0010890 A1 Jan. 19, 2006

(30) Foreign Application Priority Data

Oct. 17, 2002 (DE) ..... 102 48 510

(51) Int. Cl.
*F25B 19/00* (2006.01)

(52) U.S. Cl. ..... 62/169; 62/268

(58) Field of Classification Search ..... 62/268, 62/270, 100, 169, 170; 99/472, 467, 468, 99/427

See application file for complete search history.

(56) References Cited

U.S. PATENT DOCUMENTS

| | | | | | |
|---|---|---|---|---|---|
| 1,459,280 | A | * | 6/1923 | Card | 217/128 |
| 1,550,961 | A | * | 8/1925 | Hawkins | 62/172 |
| 2,000,882 | A | * | 5/1935 | Comstock | 220/592.26 |
| 2,109,002 | A | * | 2/1938 | Warren | 62/170 |
| 2,116,813 | A | * | 5/1938 | O'N Weisser et al. | 99/472 |
| 2,164,143 | A | | 6/1939 | Munters | |
| 2,425,816 | A | * | 8/1947 | Maxson | 62/231 |
| 2,550,040 | A | | 4/1951 | Clar | |
| 2,753,695 | A | * | 7/1956 | Maranto | 62/116 |
| 3,216,214 | A | * | 11/1965 | Gasbarro | 62/170 |
| 3,810,508 | A | * | 5/1974 | Burg et al. | 165/263 |
| RE28,995 | E | * | 10/1976 | Burg | 426/419 |
| 5,157,940 | A | * | 10/1992 | Bertu et al. | 62/382 |
| 5,271,240 | A | * | 12/1993 | Detrick et al. | 62/268 |
| 5,361,598 | A | * | 11/1994 | Roseen | 62/229 |
| 5,509,248 | A | | 4/1996 | Dellby et al. | |
| 5,765,379 | A | | 6/1998 | Jensen | |
| 6,062,040 | A | | 5/2000 | Bostic et al. | |
| 6,090,422 | A | | 7/2000 | Taragan et al. | |

(Continued)

FOREIGN PATENT DOCUMENTS

DE 202 00 781 U1 5/2002

(Continued)

*Primary Examiner*—Mohammad M. Ali
(74) *Attorney, Agent, or Firm*—Russell W. Warnock; James E. Howard

(57) ABSTRACT

A refrigerating device including a hollow-walled housing surrounding a first and a second storage compartment. A vacuum pump is controllably connected via a suction line to the hollow chamber of the housing and to one of the storage compartments. The pump is controlled to maintain a desired pressure range in both the housing and the storage compartment.

23 Claims, 2 Drawing Sheets

U.S. PATENT DOCUMENTS

Figure 1:
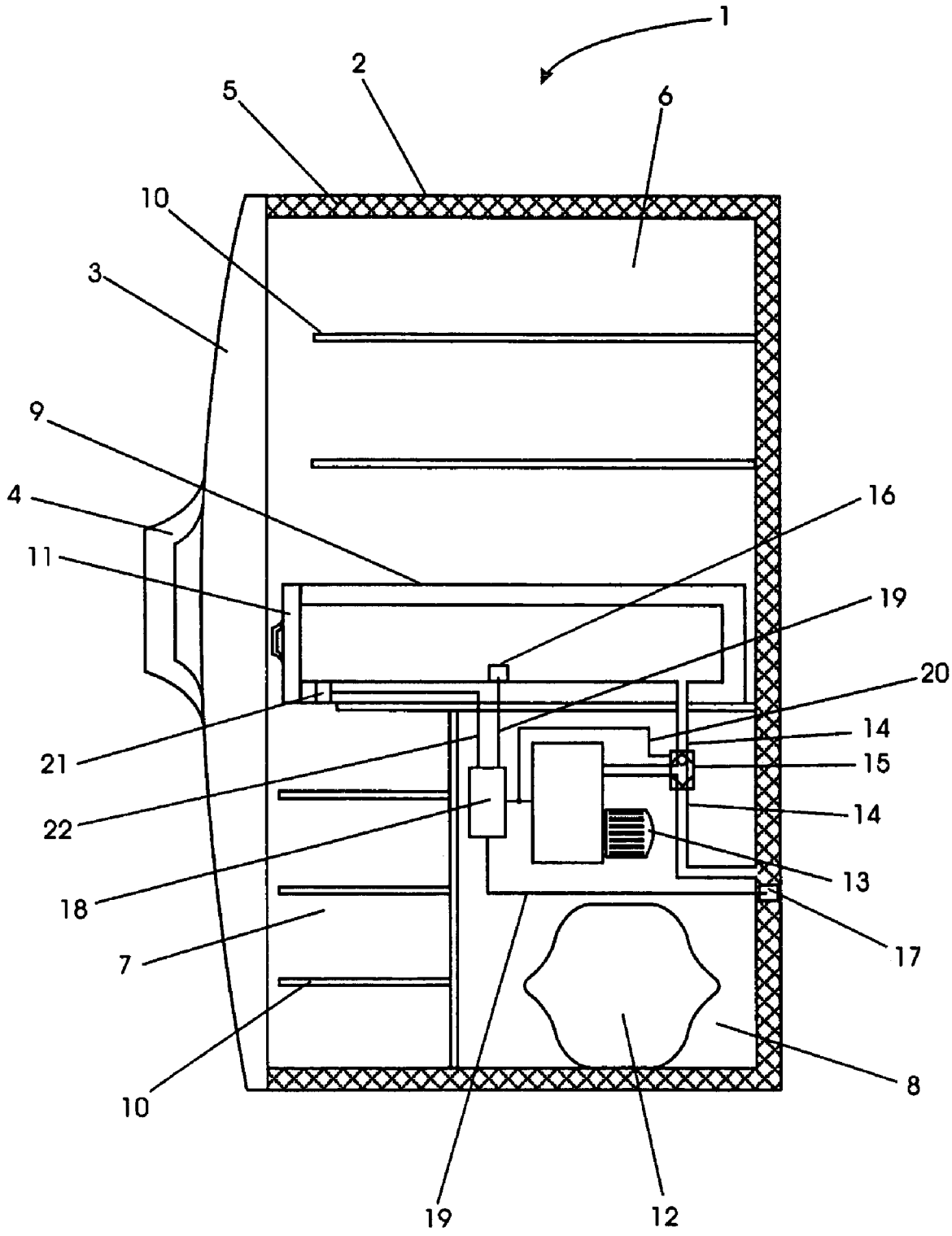

| | | | | | |
|---|---|---|---|---|---|
| 6,148,875 | A | * | 11/2000 | Breen | 141/65 |
| 6,158,233 | A | * | 12/2000 | Cohen et al. | 62/268 |
| 6,598,517 | B1 | * | 7/2003 | McCausland | 99/472 |

FOREIGN PATENT DOCUMENTS

| | | | | |
|---|---|---|---|---|
| EP | 0 474 326 | A2 | | 3/1992 |
| GB | 389535 | A | | 3/1933 |
| GB | 430123 | A | | 6/1935 |
| JP | 3-286984 | A | * | 12/1991 |
| JP | 10-103849 | A | * | 4/1998 |
| JP | 10103849 | A | | 4/1998 |
| JP | 2001-12837 | A | * | 1/2001 |
| WO | WO 90/13779 | A | | 11/1990 |
| WO | WO 01/71263 | A1 | | 9/2001 |

* cited by examiner

REFRIGERATING DEVICE COMPRISING AN EVACUATABLE STORAGE COMPARTMENT

The invention relates to a refrigerating device comprising a hollow-walled housing surrounding a storage compartment and comprising a vacuum pump which is connected to a hollow chamber of the housing via a suction line.

It is known that the storage of readily perishable foodstuffs under vacuum improves their keeping quality. Thus, for example, a refrigerator is disclosed in WO 01/712 63 A1 in which a storage compartment is provided to hold readily perishable foodstuffs. The storage compartment can be evacuated in order to improve the keeping quality of the foodstuffs. In order to achieve a vacuum inside the storage compartment, a pumping device is provided for the storage compartment. In this case, the pumping device is integrated into the refrigerator and takes up a considerable fraction of the refrigerator volume at the expense of storage space in the refrigerator.

It is also known to manufacture refrigerating devices with hollow-walled housings which can be evacuated since such housings considerably improve the thermal insulation of the refrigerator interior. A distinction is made here between hermetically sealed systems and actively pumped systems. In the hermetically sealed systems the vacuum is maintained inside the hollow-walled housing after a single evacuation process for the lifetime of the refrigerator. These include vacuum insulation panels and hermetically sealed complete housings. As a result of the extreme requirements with regard to vacuum tightness, however, these systems are expensive to manufacture and very costly. Thus, for example, the high vacuum requirements can only be ensured by a stainless steel jacket. Actively pumped systems on the other hand use substantially cheaper plastic housings which are easier to process, which can be filled with a supporting body material which can be correspondingly evacuated. However, in these systems a pump fixedly connected to the housing or an absorption system is required to maintain the vacuum.

The object of the present invention is to provide an inexpensive refrigerating device with which readily perishable foodstuffs can be preserved over a fairly long time.

The object is solved by a refrigerating device having the features of the preamble of claim 1 in which the suction line is further connected to the storage compartment.

The refrigerating device according to the invention combines the advantages of an evacuatable storage compartment with the advantages of an actively pumped refrigerating device. Since according to the invention, the same vacuum pump is responsible for generating a vacuum both in the hollow-walled housing and in the storage compartment, a second vacuum pump can be dispensed with. As a result, the manufacturing costs for the refrigerating device and also its operating costs are reduced because only one vacuum pump which is an energy consumer is provided. Finally, as a result of using only one pump, less space is required so that larger storage space capacities are available in the interior of the refrigerating device.

In the refrigerating device according to the invention the housing can surround an interior space in which the storage compartment and a non-evacuatable storage chamber are located. Thus, in the same refrigerating device less-readily perishable foodstuffs can be stored together with the readily perishable foodstuffs which are stored in the evacuated storage compartment without it being necessary to destroy the vacuum in the storage compartment during their removal from the refrigerating device.

Advantageously the refrigerating device has a control circuit for controlling the pump using at least one pressure sensor arranged on the suction side of the pump. Using such a pressure sensor it can be identified when the pressure in the hollow-walled housing or in the storage compartment exceeds a certain value in order to cause the pump to extract the excess pressure in such a case. In this way, power-consuming unnecessary permanent operation of the pump is avoided since this is only put into operation when there is a need to maintain a required underpressure.

In this case, the refrigerating device advantageously has a switching valve in the suction line for selectively connecting the pump to the hollow chamber or to the storage compartment. Thus, as required the pumping action of the pump can be switched over between the hollow chamber and the storage compartment by the control circuit.

In this case, the control circuit controls the position of the valve using at least one pressure sensor.

The control circuit can be connected to a sensor to record the evacuatability of the storage compartment. The storage compartment can then be evacuated if it is hermetically sealed with respect to the environment, i.e., if a door for removal or for insertion of the foodstuffs is closed. With such a sensor, operation of the pump when the door is open and associated severe loading of the pump can be avoided.

The control circuit advantageously controls the switching valve to connect the storage compartment to the pump when the evacuatability sensor records the evacuatability of the storage compartment. As mentioned above, the evacuatability of the storage compartment is provided when the door of the storage compartment is closed so that the pump can bring about a reduction in pressure inside the storage compartment when the door is closed.

In one embodiment the evacuatability sensor is arranged on a door of the storage compartment to record the opening and closing state of the door.

In a further embodiment, the evacuatability sensor is a pressure sensor and the valve has a switching position in which it has a high admittance between storage compartment and pump and one switching position with a small non-vanishing conductance between storage compartment and pump. If, in such an embodiment, the evacuatable storage compartment is flooded in order to be able to open its door, the control circuit immediately switches the switching valve into the switching position with the low admittance. If the pump is now put into operation, possibly because the pressure sensor is arranged on the evacuatable compartment and records an excessively high pressure, only a small air flow is now extracted from the evacuatable compartment. As long as the door is open, the pressure inside the storage compartment does not drop but remains at a constant value corresponding to the external ambient pressure, which is also detected by the pressure sensor. A lack of a pressure drop is the signal for the control circuit that the door of the storage compartment is open. A pressure drop which is recorded by the sensor only occurs when the door of the storage compartment is closed again. Only when the sensor thus indicates the evacuatability of the storage compartment does the control circuit switch the switching valve into the position with the high admittance and the storage compartment is speedily evacuated.

The hollow chamber of the housing advantageously has a loose filling of a supporting material. The supporting material imparts an increased stability to the hollow-walled housing.

In this case, the supporting material is preferably porous. Such a supporting material contributes to the thermal insulation of the interior of the refrigerating device.

The supporting material is especially preferably a silicic-acid or aerogel-based granular material.

The pump is advantageously a rough-vacuum pump. A rough vacuum is understood as a pressure of about 100 mbar. Rough-vacuum pumps are more robust and less expensive compared to high-vacuum pumps. Especially if the hollow cavity of the housing is filled with a supporting material, a rough vacuum of about 100 mbar is already sufficient to bring about a significant improvement in the insulation of the interior of the refrigerating device compared with a non-evacuated state of the hollow chamber of the housing of the refrigerating device.

The storage compartment an/or the hollow chamber especially preferably have plastic walls. An important advantage of plastic walls is their cheapness and ease of processing.

Figure 2:
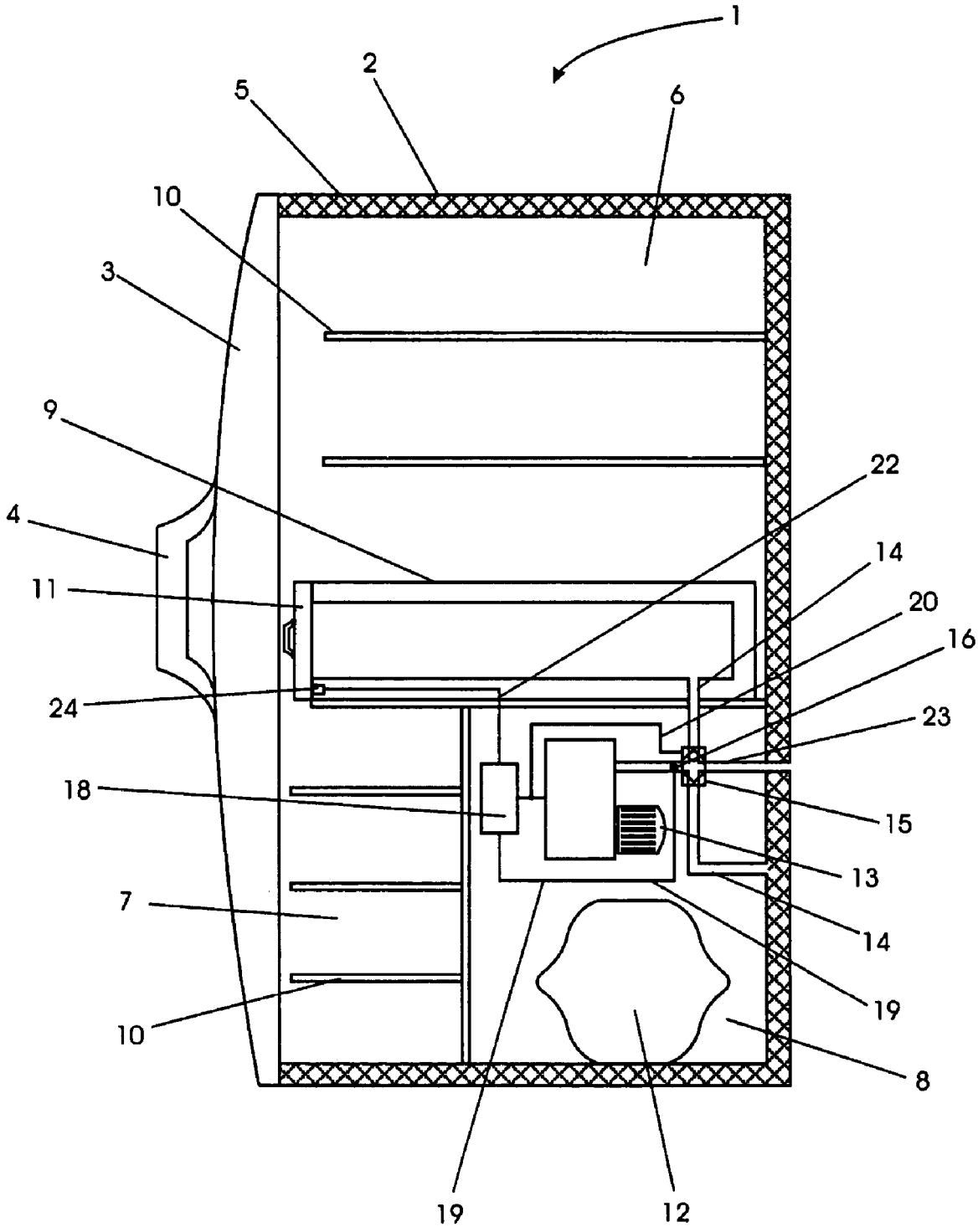

The invention is explained in detail in the following with reference to two exemplary embodiments. In the figures:

FIG. 1 is a cross-section through a refrigerator according to the invention; and FIG. 2 is a cross-section through a further refrigerator according to the invention.

FIG. 1 shows a cross-section through a refrigerator 1 as an example for a refrigerating device according to the invention. The refrigerator 1 has a rectangular external shape and is surrounded by a hollow-walled housing 2 with the exception of one front side. In this case, the hollow-walled housing 2 is filled with a porous supporting material 5 which comprises a silicic-acid or aerogel-based granular material. Provided at the front of the refrigerator 1 is a hinged front door 3 with a handle 4 in order to obtain access via this to an interior space of the refrigerator 1.

The interior of the refrigerator 1 is divided into an upper storage chamber 6, a lower storage chamber 7, an operating region 8 arranged next to the lower storage chamber 7 and a region occupied by an evacuatable storage compartment 9. In this case, the upper storage chamber 6 is separated from the lower storage chamber 7 and the operating region 8 by the storage compartment 9. Horizontally aligned depositing surfaces or depositing grids 10 are provided in the upper storage chamber 6 and in the lower storage chamber 7. The storage compartment 9 has a flap 11 on the front side via which the food can be placed in the storage compartment 9 or removed therefrom. In the evacuated state the flap 11 is pressed against the housing of the storage compartment 9 by the ambient pressure such that it is hermetically sealed. A flooding valve 21 is provided on the housing of the storage compartment 9.

A compressor 12, a pump 13, a valve 15 and a control unit 18 are provided in the operating region 8. A vaporiser and condenser which together with the compressor 12 form a coolant circuit are not shown for the sake of clarity. The pump 13 is a rough-vacuum pump which is set to a target pressure of 100 mbar. It is connected via a suction line 14 to the inner hollow chamber of the housing 2 and to the evacuatable storage compartment 9. Arranged on a fork of the suction line 14 is a switching valve 15 which is designed to take on a plurality of switching positions under the control of the control unit 18. It has respectively one switching position in which it connects the pump 13 to the storage compartment 9 or the hollow chamber of the housing 2 with a high admittance and one switching position in which it connects the pump 13 to the storage compartment 9 with a low admittance. The control unit 18 further serves to control the pump 13. For this purpose it is connected via control lines 20 to the pump 13 and the valve 15. It is furthermore connected by means of a data line 22 to the flooding valve 21 and by means of data lines 19 to two pressure sensors 16 and 17 wherein the sensor 16 is arranged in the interior of the storage compartment 9 and the sensor 17 is arranged in the hollow chamber of the hollow-walled housing 2. The pressure sensors 16, 17 each detect a pressure inside the storage compartment 9 or in the hollow chamber of the hollow-walled housing 2 and transmit the result of their measurement via the data lines 19 to the control unit 18.

During operation of the refrigerator 1 the pressure in the interior of the storage compartment 9 and in the interior of the hollow-walled housing 2 is constantly measured by the pressure sensors 16 and 17 and the result of the measurement is passed onto the control unit 18. In this case, a maximum upper limit which must not be exceeded, is pre-determined both for the pressure in the interior of the storage compartment 9 and also for the pressure in the interior of the housing 2. If one of the two sensors 16 or 17 detects that the pressure monitored by it exceeds this limit, the control unit 18 responds by controlling the valve 15 and switching the valve 15 such that the pump 13 is connected via the suction line 14 to the storage compartment 9 or to the hollow chamber of the housing 2 depending on in which of the two the exceeding of the limit for the pressure was detected by the corresponding sensor 16, 17. In addition, the control unit 18 sets the pump 13 in operation so that the excess pressure is extracted and the total pressure in the storage compartment 9 or the housing 2 falls below the pre-determined limit again. As soon as the corresponding sensor 16 or 17 detects a pressure which has a pre-determined difference from the upper limit for the pressure, the control unit 18 switches the pump 13 off again. In this way, it is ensured that the pump 13 only operates when it is required to extract an excess pressure whereby unnecessary energy consumption is avoided.

The flap 11 must be opened to remove or deposit food from or into the storage compartment 9. For this purpose, the interior of the storage compartment 9 must be flooded. For this purpose, the flooding valve 21 is provided which is actuated manually and closes as soon as it is released by the user. In addition, the flap 11 is designed so that it bursts open after the pressure has been equalised. If a user opens the flooding valve 21 and air flows into the storage compartment 9, the pressure sensor 16 registers a pressure rise which causes the control unit 18 to switch on the pump 13. At the same time, the control unit 18 receives a signal via the data line 22 which indicates that the flooding valve 21 is open. The control unit 18 responds to this by bringing the switching valve 15 into the switching position in which it connects the pump 13 and the storage compartment 9 with low admittance. Whilst the storage compartment is open, the pump 13 continuously extracts a small, non-vanishing air flow from the storage compartment 9.

In order to hermetically seal the storage compartment 11 again, the flap 11 is pressed shut when the flooding valve 21 is released. As soon as the flap 11 is closed, the small air flow extracted from the storage compartment 9 by the pump 13 is sufficient to slightly reduce the pressure inside the storage compartment 9. The pressure reduction is recorded by the pressure sensor 16 and is the signal for the control unit 18 that the flap 11 was closed. Via the control line 20 said control unit therefore controls the valve 15 to connect the pump 13 with high admittance to the storage compartment 9 so that the pump 13 from now on rapidly reduces the pressure inside the storage compartment 9. If this pressure goes below a lower pre-determined value, the pump 13 is switched off again by the control unit 18. Only when the sensors 16 or 17 register that the pressures monitored by them in the storage compartment 9 or in the hollow chamber of the housing 2 exceed one of the pre-determined limits, is the pump 13 started up again by the control unit 18 and connected via the valve 15 as required either to the storage compartment 9 or to the hollow chamber of the hollow-walled housing 2.

In the further embodiment of the refrigerator 1 according to the invention shown in cross-section in FIG. 2, the storage compartment 9 has no flooding valve unlike the embodiment shown in FIG. 1. A further difference from the embodiment shown in FIG. 1 is that the refrigerator shown in FIG. 2 is only fitted with one pressure sensor 16 which is arranged in the suction pipe 14 between the pump 13 and the valve 15 and is connected via the data line 19 to the control unit 18. Furthermore a door sensor 24 is also provided on the flap 11 which is also connected to the control unit 18 via the data line 22. The valve 15 has a fourth connection at which a ventilation line 23 open to the surroundings of the refrigerator discharges. The valve 15 can be switched between three switching positions: in a first switching position the ventilation line 23 is connected to the interior of the storage compartment 9 via the suction line 14 whereas the branch of the suction line 14 leading to the hollow chamber of the housing 2 is shut off; in a second switching position the ventilation line 23 and the branch of the suction line 14 leading to the hollow chamber of the housing 2 are shut off whereas the pump 13 is connected to the storage compartment via the valve 15, and in a third switching position the ventilation line 23 and the branch of the suction line 14 leading to the storage compartment 9 are shut off.

During normal operation of the refrigerator 1 the valve is in the third switching stage so that the pump 13 is connected to the hollow chamber of the housing 2 via the suction line 14. In this case, the same pressure prevails in the suction line 14 as in the hollow chamber. This is measured by the sensor 16 and communicated via the data line 19 to the control unit 18. As in the embodiment in FIG. 1, a limit for the pressure is defined for the control unit wherein, if this limit is exceeded by the pressure, the control unit 18 causes the pump 13 to pump away any excess pressure. As soon as the pressure lies below a pre-determined pressure again, the pump 13 is switched off by the control unit 18.

To open the flap 11 of the storage compartment 9 the control unit 18 is made to switch the valve 15 to the first switching stage by means of a manual switch not shown. As a result, the interior of the storage compartment 9 is flooded with ambient air via the suction line 14 and the ventilation line 23 until pressure equalisation has been established. The flap 11 is then opened or it bursts open when the pressure is equalised.

In order to hermetically seal the storage compartment 9 again, the flap 11 is pressed to. In this case, the door sensor 24 registers the closed state (for example, by means of the presence of an electrical contact or an interruption of an electrical contact) and passes this information on to the control unit 18 via the data line 22. This causes the valve 15 to switch to the second switching stage so that the pump 14 is connected to the interior of the storage compartment 9 via the suction line 14 whilst the ventilation line 23 is shut off and the hollow chamber of the housing 2 is separated from the pump 13. Now the pump 13 can pump out the storage compartment 9. The pressure sensor 16 again registers the prevailing pressure and transmits its measurement result to the control unit 18. As soon as the pressure falls below a pre-determined value, the valve 15 is again switched to the third switching stage by the control unit 18 and the pump 13 is switched off. The refrigerator 1 immediately takes up its normal operation.

The invention claimed is:

1. A refrigerating device, comprising:
an exterior door;
a non-evacuatable storage chamber;
an exterior hollow-walled housing forming a hollow chamber therein, said hollow-walled housing and said door surrounding said storage chamber;
an evacuatable storage compartment positioned within said storage chamber;
a vacuum pump connected via a suction line to both said storage compartment and said hollow chamber; and
at least one pressure sensor arranged on the suction side of said pump and a control circuit coupled to said pressure sensor for controlling said pump.

2. The refrigerating device according to claim 1, wherein said non-evacatuable storage chamber is defined by said hollow-walled housing and said door forming an interior space and includes an upper storage chamber and a lower storage chamber with said evacuatable storage compartment located therebetween.

3. The refrigerating device according to claim 1, including a switching valve coupled to said suction line for selective connection of said pump to at least one of said storage compartment and said hollow chamber.

4. The refrigerating device according to claim 3, including said control circuit controlling said selective connection of said switching valve in response to said pressure sensor.

5. The refrigerating device according to claim 4, including a sensor coupled to said control circuit for recording the evacuatability of said storage compartment.

6. The refrigerating device according to claim 5, including said control circuit controlling said selective connection of said switching valve in order to connect said storage compartment to said pump when said evacuatability sensor records a predetermined evacuatability of said storage compartment.

7. The refrigerating device according to claim 5, including said storage compartment having a door and said evacuatability sensor coupled to said door to record the opening and closing state of said door.

8. The refrigerating device according to claim 5, including said evacuatability sensor is a pressure sensor and said switching valve has a first switching connection in which said switching valve forms a high admittance between said storage compartment and said pump and has a second switching connection in which said switching valve forms a non-vanishing low admittance between said storage compartment and said pump.

9. The refrigerating device according to claim 1, including said hollow chamber contains a loose filling of a support material.

10. The refrigerating device according to claim 9, including said support material is a porous material.

11. The refrigerating device according to claim 10, including said support material is at least one of a silicic acid or an aerogel-based granular material.

12. The refrigerating device according to claim 1, including said pump is a rough vacuum pump.

13. The refrigerating device according to claim 1, including at least one of said storage compartment and said hollow-walled housing have walls made of a plastic material.

14. A refrigerating device, comprising:

an exterior door;

a non-evacatuable storage chamber;

an exterior hollow-walled housing forming a hollow chamber therein, said hollow-walled housing and said door forming an interior space defining said storage compartment;

an evacuatable storage compartment positioned within said storage chamber;

a vacuum pump connected via a suction line to both said storage compartment and said hollow chamber;

a switching valve coupled to said suction line for selective connection of said pump to at least one of said storage compartment and said hollow chamber;

at least one pressure sensor arranged on the suction side of said pump; and a control circuit coupled to said pressure sensor for controlling said pump; and control circuit controlling said selective connection of said switching valve in response to said pressure sensor.

15. The refrigerating device according to claim 14, including a sensor coupled to said control circuit for recording the evacuatability of said storage compartment and said control circuit controlling said selective connection of said switching valve in order to connect said storage compartment to said pump when said evacuatability sensor records a predetermined evacuatability of said storage compartment.

16. The refrigerating device according to claim 15, including said storage compartment having a door and said evacuatability sensor coupled to said door to record the opening and closing state of said door.

17. The refrigerating device according to claim 15, including said evacuatability sensor is a pressure sensor and said switching valve has a first switching connection in which said switching valve forms a high admittance between said storage compartment and said pump and has a second switching connection in which said switching valve forms a non-vanishing low admittance between said storage compartment and said pump.

18. The refrigerating device according to claim 14, including said storage compartment and said hollow-walled housing have walls made of a plastic material said hollow chamber contains a loose filling of a porous support material.

19. A refrigerating device, comprising:

a door;

at least one storage compartment;

a hollow-walled housing forming a hollow chamber therein, said hollow-walled housing and said door surrounding said storage compartment;

a vacuum pump connected via a suction line to both said storage compartment and said hollow chamber;

at least one pressure sensor arranged on the suction side of said pump and a control circuit coupled to said pressure sensor for controlling said pump;

a switching valve coupled to said suction line for selective connection of said pump to at least one of said storage compartment and said hollow chamber;

said control circuit controlling said selective connection of said switching valve in response to said pressure sensor;

a sensor coupled to said control circuit for recording the evacuatability of said storage compartment; and said storage compartment having a door and said evacuatability sensor coupled to said door to record the opening and closing state of said door.

20. A refrigerating device, comprising:

a door;

at least one storage compartment;

a hollow-walled housing forming a hollow chamber therein, said hollow-walled housing and said door surrounding said storage compartment;

a vacuum pump connected via a suction line to both said storage compartment and said hollow chamber;

at least one pressure sensor arranged on the suction side of said pump and a control circuit coupled to said pressure sensor for controlling said pump;

a switching valve coupled to said suction line for selective connection of said pump to at least one of said storage compartment and said hollow chamber;

said control circuit controlling said selective connection of said switching valve in response to said pressure sensor;

a sensor coupled to said control circuit for recording the evacuatability of said storage compartment; and said evacuatability sensor is a pressure sensor and said switching valve has a first switching connection in which said switching valve forms a high admittance between said storage compartment and said pump and has a second switching connection in which said switching valve forms a non-vanishing low admittance between said storage compartment and said pump.

21. A refrigerating device, comprising:

a door;

at least one storage compartment;

at least one non-evacatuable storage chamber;

a hollow-walled housing forming a hollow chamber therein, said hollow-walled housing and said door forming an interior space surrounding said storage compartment and a non-evacatuable storage chamber;

a vacuum pump connected via a suction line to both said storage compartment and said hollow chamber;

a switching valve coupled to said suction line for selective connection of said pump to at least one of said storage compartment and said hollow chamber;

at least one pressure sensor arranged on the suction side of said pump;

a control circuit coupled to said pressure sensor for controlling said pump, said control circuit controlling said selective connection of said switching valve in response to said pressure sensor;

a sensor coupled to said control circuit for recording the evacuatability of said storage compartment and said control circuit controlling said selective connection of said switching valve in order to connect said storage compartment to said pump when said evacuatability sensor records a predetermined evacuatability of said storage compartment; and said storage compartment having a door and said evacuatability sensor coupled to said door to record the opening and closing state of said door.

22. A refrigerating device, comprising:

a door;

at least one storage compartment;

at least one non-evacatuable storage chamber;

a hollow-walled housing forming a hollow chamber therein, said hollow-walled housing and said door forming an interior space surrounding said storage compartment and a non-evacatuable storage chamber;

a vacuum pump connected via a suction line to both said storage compartment and said hollow chamber;

a switching valve coupled to said suction line for selective connection of said pump to at least one of said storage compartment and said hollow chamber;

at least one pressure sensor arranged on the suction side of said pump;

a control circuit coupled to said pressure sensor for controlling said pump, said control circuit controlling said selective connection of said switching valve in response to said pressure sensor;

a sensor coupled to said control circuit for recording the evacuatability of said storage compartment and said control circuit controlling said selective connection of said switching valve in order to connect said storage compartment to said pump when said evacuatability sensor records a predetermined evacuatability of said storage compartment; and said evacuatability sensor is a pressure sensor and said switching valve has a first switching connection in which said switching valve forms a high admittance between said storage compartment and said pump and has a second switching connection in which said switching valve forms a non-vanishing low admittance between said storage compartment and said pump.

23. A refrigerating device, comprising:

an exterior door;

a non-evacuatable storage chamber;

an exterior hollow-walled housing forming a hollow chamber therein, said hollow-walled housing and said door surrounding said storage chamber;

an evacuatable storage compartment positioned within said storage chamber;

a vacuum pump connected via a suction line to both said storage compartment and said hollow chamber;

at least one pressure sensor arranged on the suction side of said pump and a control circuit coupled to said pressure sensor for controlling said pump; and an evacuatability sensor for recording the evacuatability of said storage compartment, said storage compartment having a door and said evacuatability sensor being coupled to said control circuit for recording the evacuatability of said storage compartment and to said door to record the opening and closing state of said door.

* * * * *